US009423219B2

(12) United States Patent
Pedersen et al.

(10) Patent No.: US 9,423,219 B2
(45) Date of Patent: Aug. 23, 2016

(54) VIBRATION DAMPING NOCK CONSTRUCTION

(71) Applicant: Out RAGE, LLC, Cartersville, GA (US)

(72) Inventors: William E. Pedersen, Duluth, MN (US); Christopher M. James, Cartersville, GA (US); Jon A. Syverson, Cloquet, MN (US)

(73) Assignee: Out RAGE, LLC, Superior, WI (US)

( * ) Notice: Subject to any disclaimer, the term of this patent is extended or adjusted under 35 U.S.C. 154(b) by 0 days.

(21) Appl. No.: 14/832,764

(22) Filed: Aug. 21, 2015

(65) Prior Publication Data

US 2015/0362299 A1 Dec. 17, 2015

Related U.S. Application Data

(63) Continuation of application No. 13/998,213, filed on Oct. 11, 2013, now Pat. No. 9,140,527.

(51) Int. Cl.
*F42B 6/06* (2006.01)
*F42B 6/02* (2006.01)

(52) U.S. Cl.
CPC .. *F42B 6/06* (2013.01); *F42B 6/02* (2013.01)

(58) Field of Classification Search
CPC ..... F42B 6/06
See application file for complete search history.

(56) References Cited

U.S. PATENT DOCUMENTS

| | | | |
|---|---|---|---|
| 2,484,589 | A | 10/1949 | Richards |
| 2,887,319 | A | 5/1959 | Lay |
| 4,003,576 | A | 1/1977 | Carella |
| 4,305,588 | A | 12/1981 | Dodge |
| 4,340,930 | A | 7/1982 | Carissimi |
| 4,547,837 | A | 10/1985 | Bennett |
| 4,645,211 | A | 2/1987 | Beiter |
| D301,272 | S | 5/1989 | Barrow et al. |
| 4,856,792 | A | 8/1989 | Hardison |
| 4,900,037 | A | 2/1990 | Miller |
| 5,134,552 | A | 7/1992 | Call et al. |
| 5,154,432 | A | 10/1992 | Saunders |
| 5,306,020 | A | 4/1994 | Bolf |
| 5,516,857 | A | 5/1996 | Mann |
| 5,688,890 | A | 11/1997 | Ishiguro et al. |
| 5,959,059 | A | 9/1999 | Vedula et al. |
| 6,123,631 | A | 9/2000 | Ginder |
| 6,364,499 | B1 | 4/2002 | Jones |
| 6,390,642 | B1 | 5/2002 | Simonton |
| 6,695,727 | B1 | 2/2004 | Kuhn |

(Continued)

FOREIGN PATENT DOCUMENTS

| | | | |
|---|---|---|---|
| FR | 2777647 | A1 | 10/1999 |
| GB | 2320207 | A | 6/1998 |

OTHER PUBLICATIONS

Archery Talk—Archers Helping Archers Forum: "Homemade Stuff?", http://www.archerytalk.com/vb/showthread.php?t=201870 &page=48&p=5786267 (2007).

(Continued)

*Primary Examiner* — John Ricci

(74) *Attorney, Agent, or Firm* — Covington & Burling LLP; Gregory S. Discher; Grant D. Johnson

(57) ABSTRACT

A vibration damping nock for crossbow arrows includes an insert to absorb bow string slap, thereby to prevent damage to the nock during crossbow firing.

18 Claims, 6 Drawing Sheets

(56) References Cited

U.S. PATENT DOCUMENTS

| | | | | |
|---|---|---|---|---|
| 6,736,742 | B2 | 5/2004 | Price et al. | |
| 7,021,784 | B2 | 4/2006 | DiCarlo | |
| 7,189,170 | B1 | 3/2007 | Korsa et al. | |
| 7,211,011 | B1 | 5/2007 | Sutherland | |
| 7,374,504 | B2 | 5/2008 | Palomaki et al. | |
| 7,837,580 | B2 | 11/2010 | Huang et al. | |
| 7,862,457 | B1 | 1/2011 | Urcheck | |
| 7,922,609 | B1 | 4/2011 | Hajari | |
| 7,927,240 | B2 | 4/2011 | Lynch | |
| 7,931,550 | B2 | 4/2011 | Lynch | |
| 7,993,224 | B2 | 8/2011 | Brywig | |
| 8,123,636 | B1 | 2/2012 | Temprine | |
| D664,625 | S | 7/2012 | Minica | |
| 8,257,208 | B2 | 9/2012 | Harding | |
| D669,955 | S | 10/2012 | Minica | |
| D669,956 | S | 10/2012 | Minica | |
| 8,342,990 | B1 | 1/2013 | Price | |
| 8,540,594 | B2 | 9/2013 | Chu | |
| 8,622,855 | B2 | 1/2014 | Bednar et al. | |
| 8,758,177 | B2 | 6/2014 | Minica | |
| 8,795,109 | B2 | 8/2014 | Roman | |
| 9,140,527 | B2 * | 9/2015 | Pedersen | F42B 6/02 |
| 2002/0039939 | A1 | 4/2002 | Hartman | |
| 2003/0166425 | A1 | 9/2003 | Sutherland et al. | |
| 2009/0097239 | A1 | 4/2009 | Lynch | |
| 2012/0100942 | A1 | 4/2012 | Minica | |
| 2013/0267359 | A1 | 10/2013 | Pedersen | |
| 2014/0187362 | A1 | 7/2014 | Pedersen et al. | |

OTHER PUBLICATIONS

Archery Talk—Archers Helping Archers Forum: "Homemade Stuff?", http://www.archerytalk.com/vb/showthread.php?t=201870&page=48&p=5791405 (2007).

Archery Talk—Archers Helping Archers Forum: "Homemade Stuff?", http://www.archerytalk.com/vb/showthread.php?t=201870&page=62&p=1056170361 (2009).

PCT International Search Report (PCT Article 18 and Rules 43 and 44) for PCT/US2013/076108, Mar. 13, 2014.

PCT Written Opinion of the International Searching Authority (PCT Rule 43bis.1) for PCT/US2013/076108, Mar. 13, 2014.

International Search Report from PCT/US2014/059742, Dec. 22, 2014.

Written Opinion of the International Search Authority from PCT/US2014/059742, Dec. 22, 2014.

International Search Report from PCT/US2014/059723, Dec. 22, 2014.

Written Opinion of the International Search Authority from PCT/US2014/059723, Dec. 22, 2014.

* cited by examiner

VIBRATION DAMPING NOCK CONSTRUCTION

RELATED APPLICATIONS

This application is a continuation of U.S. patent application Ser. No. 13/998,213, filed on Oct. 11, 2013, the entire contents of which is incorporated herein by reference.

FIELD OF THE INVENTION

This invention relates to nock constructions for use with crossbows and more particularly to a vibration damping insert for reinforced nocks to absorb bow string slap.

BACKGROUND OF THE INVENTION

As shown in U.S. Patent Application Nos. 61/748,526 filed Jan. 3, 2013; 61/621,221 filed Apr. 6, 2012; and Ser. No. 13/785,862 filed Mar. 5, 2013; nocks usable with crossbows have been reinforced utilizing a metal support structure which surrounds a portion of a nock and a portion of the crossbow bolt to attempt to prevent fracture of the nock when the bolt is fired from the crossbow. It is noted that all of these patent applications are incorporated in their entirety by reference.

Whether the crossbow nock is lighted or unlighted in general crossbows have a significant safety problem in that crossbows are designed such that the string has some slight separation from the projectile prior to firing of the projectile upon release of the bow string. From a physics perspective the string travels forward and actually impacts or slaps the nock rather than pushing on the nock.

Nocks in general are plastic and existing plastic nock systems are problematic if the nock breaks. This can result in what is called a dry fire with the string moving forward without pushing on the projectile because the nock has broken or fractured. The result is that the string slides over the projectile. When this happens there is nothing to absorb all of the stored energy. Thus when the string is released all of the energy reverberates back into the bow which can cause damage to the bow itself.

As will be appreciated, in a dry fire situation in which the nock is fractured the energy is not put into the projectile but rather is put back into the bow where it can actually cause portions of the bow to break and detach, becoming a serious safety problem for the hunter or archer.

Metal nocks are known in the industry, although not used as commonly as plastic nocks. However, the metal nocks are solid and have no ability to be lighted. Lighting of nocks has proven to be a valuable means for the hunter or archer to easily track the trajectory of the projectile to correct shooting errors, and to locate the projectile after shooting. Additionally, the solid metal nocks do not have the ability to reduce the impact from the bow string, and can therefore cause unwanted vibration in the crossbow.

As a result and for crossbows in particular there is a significant need to be able to provide a plastic nock that is reinforced with either metal, a ceramic or an advanced composite that has the structural strength and ability to absorb the impact of the bow string. As mentioned above there are metal support structures that cooperate with the plastic nocks that to a certain extent limit the fracture or damage of the nock during crossbow firing. It will be appreciated that the amount of stress produced in the nock from the energy in the crossbow is over 7,000 psi.

Should the nock break or fracture not only is the bow string released with no retarding force such as would be associated with the bolt or projectile, the arrow itself can fly off at any angle thus potentially causing injury to the hunter or those nearby.

It is therefore important to be able to provide a nock structure capable of withstanding tremendous forces associated with the release of a crossbow string, the need being both for unlighted nocks and lighted nocks alike.

It will be appreciated that lighted nocks are activated when the bow string presses on a plunger which in turn presses on an internal light emitting diode assembly to close a switch between the light emitting diode and a battery pack contained within the bolt or arrow shaft. When the bow string is released the plunger is pushed in and the internal light is activated to provide a lighted nock that is used by the hunter to trace the path of the arrow and also to be able to find the arrow if it has missed its target. This in turn permits retrieval of the arrow for a missed shot.

In the case of lighted nocks a clear plastic is utilized for the nock construction so that light that is generated internal to the bolt or arrow shaft is radiated out from the lighted nock. It is therefore important to provide a lighted nock which is capable of sustaining the tremendous forces associated with the release of a crossbow bow string.

Not only is a fracture resistant nock important for lighted nocks it is likewise important for unlighted nocks. In addition to the reasons stated above, it is beneficial to have a shock absorbing elastomeric material as part of the construction of any nock, lighted or unlighted, to reduce vibration in the crossbow and bolt.

SUMMARY OF INVENTION

In order to prevent fracture of a nock, lighted or not, in the subject invention the distal portion of the nock is provided with a shock absorber insert that in essence absorbs the impact forces so that the nock will not shatter due to the slap of the bow string against the nock. An additional benefit of the system is the overall reduction in vibration in the system which tends to increase accuracy, reduce noise and improve overall shooting enjoyment from a smoother feel to the shooter.

In a preferred embodiment the nock is encased in the aforementioned metal support structure. However the distal end of the nock is provided with the shock absorbing material, in one case TPU or thermopolymer urethane or thermoplastic urethane as it is sometimes called. In one embodiment, the TPU shock absorber is injection molded into an aluminum housing and absorbs the impact to prevent the nock from breaking or shattering during firing, especially when there is a space between the bow string and the distal end of the nock causing a high impact slap against the nock that otherwise might cause the nock to fracture.

The preferred material for the shock absorber at the distal end of the nock is clear TPU. From a structural perspective the TPU allows some resilience and therefore vibration damping. As a result the slap from the string will be damped. It is noted that urethane has extremely good impact absorption characteristics, and is a material commonly used for skate wheels. It also has good absorption resistance as well as good impact absorption characteristics. Since the TPU is preferably clear, it allows a lighted nock to not only have the structural benefits from this insert but will also allow a light from a light assembly to exit to the rear of the bolt or arrow shaft when a battery and LED assembly is located at the proximal portion of the TPU insert.

Moreover, when the TPU insert is impacted by the bow string it moves slightly forward in the structural housing such that rather than having to utilize a plunger or pin to push the LED light emitting unit forward to make switch contact, the TPU insert itself forms a plunger like function that moves upon impact to push the end of a dome-shaped LED forward in the bolt or arrow shaft, whereupon traditional switch contact is made to illuminate the LED.

It is preferable to use injection moldable urethane as opposed to a castable urethane or a two part urethane. This is important because injection moldable TPU urethanes are stronger and more impact resistant than castable urethanes. Note first and foremost TPU must have the requisite strength. Secondly, it must have resilience or ability to absorb energy without permanent deformation. Thirdly, it must have good spring back characteristics after it has been pushed out of its shape so that it will spring back to its original shape without permanent deformation. Fourthly, it must have good vibration damping and have the requisite toughness as well as abrasion resistance. The above characteristics are best embodied in the TPU material which allows one to build the insert as a mechanical button comprising a molded piece of clear urethane. As the string moves forward it pushes the clear TPU forward to close a switch in the lighted nock assembly.

Note that there are a few alternate materials to TPU, but if so, they must be optically as clear as possible and must transmit a large portion of the light out the distal end of the nock. Other exemplary materials that could be used would be commonly referred to as thermoplastic elastomers (TPEs) or simply rubber materials. While rubber could not be used in a lighted nock, it would be sufficient in an unlighted application.

The TPU insert in the distal end of the nock may either have a notch or half-moon configuration to control the string motion appropriately to keep it from slipping off the back of the projectile. In another embodiment the TPU insert may be a flat disk button which is contacted by the bow string.

In summary, a shock absorbing insert is placed at the distal end of a nock, lighted or not, in which the insert serves as a shock absorber to prevent fracture or damage to the nock during crossbow firing, thus to eliminate safety problems associated with crossbow string slap. An additional benefit is the overall reduction in vibration throughout the crossbow and projectile system.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
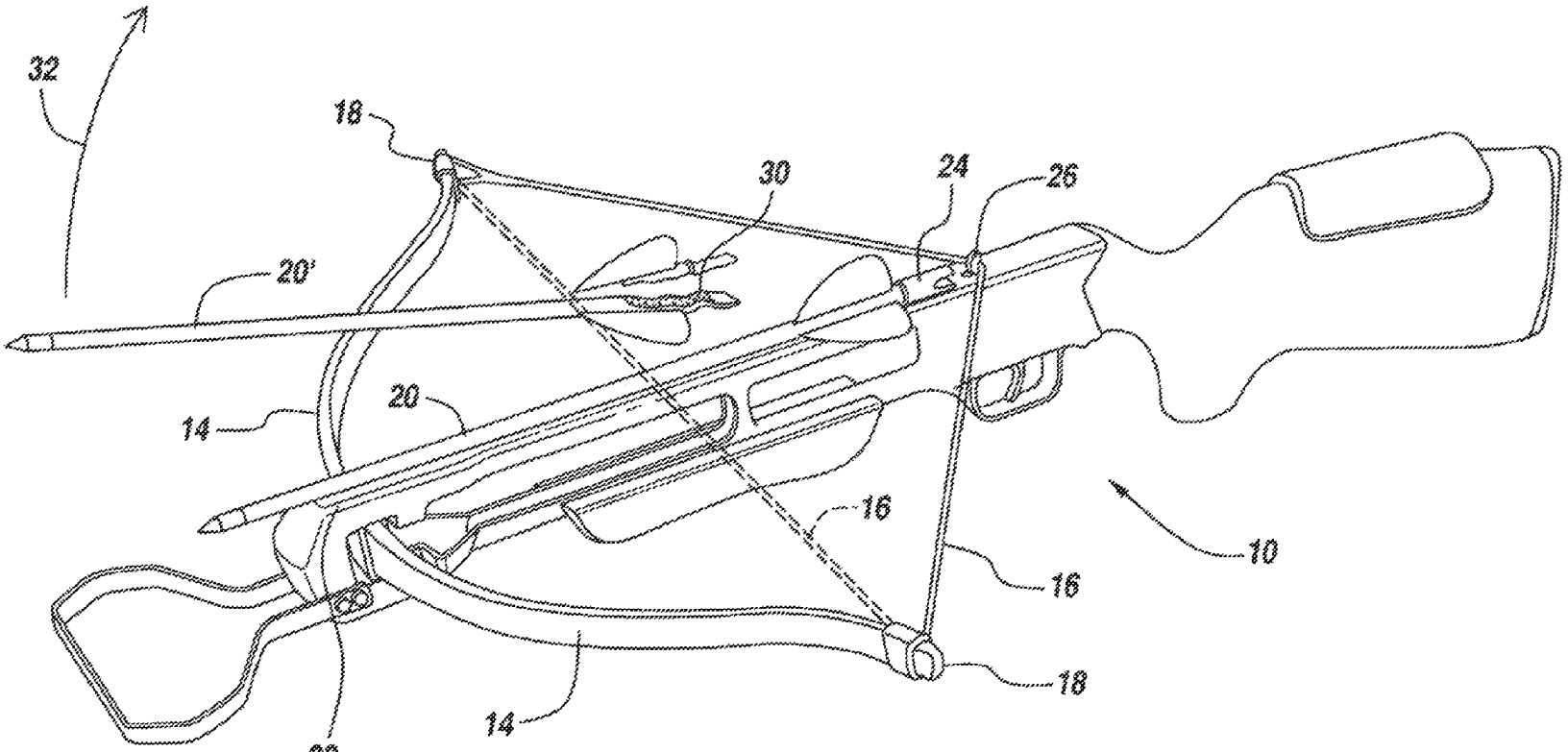
FIG. 1 is a diagrammatic illustration of a crossbow showing the separation between the bow string and the end of a typical nock at the distal end of a bolt, also showing the result of fracturing the nock during firing causing the bow string to be unloaded, also causing the arrow to move out of the crossbow chamber in an uncontrolled fashion.

Referring now to FIG. 1, a simplified crossbow 10 is provided with limbs 14 having a bow string 16 attached to the distal ends 18 of the limbs 14. A bolt 20 is inserted into the breach 22 of the crossbow 10 in which bolt 20 has a nock 24 generally made of plastic which is adapted to be struck by bow string 16 when bow string 16 is released by trigger mechanism 26, thus to project the bolt 20 forward upon bow string 16 release.

The problem with such a nock construction is that the nock may fracture as illustrated at 30 with the slap of bow string 16 against the distal end of the nock 30. Not only does the fracturing of the nock 30 eliminate all loading on the bow string 16 as it is released which can cause fracture it also can cause the bolt shown at 20' to move off axis as illustrated by arrow 32 which can impact hunters or other people nearby, a clear safety problem.

Figure 2:
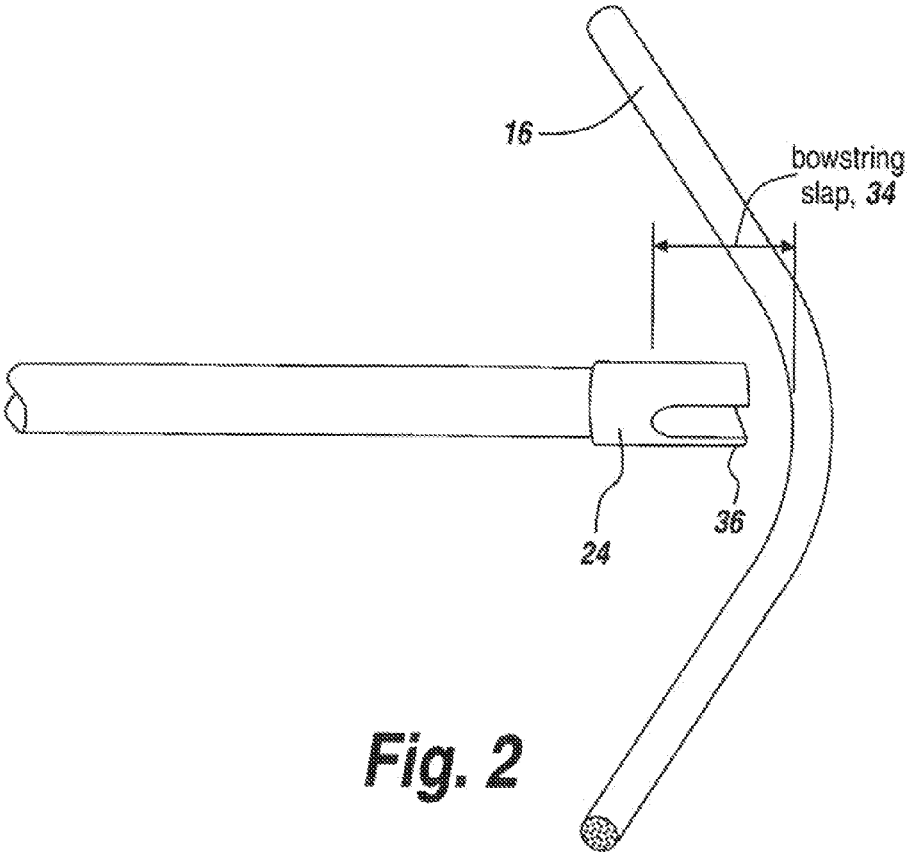
FIG. 2 is a diagrammatic illustration showing the spacing of a crossbow bow string from the distal end of the nock, showing the spacing over which bow string slap is operative.

Referring to FIG. 2, the problem with crossbows is that there is often a small but significant offset distance indicated by arrow 34 from the distal end 36 of nock 24 such that upon release of the bow string 16, the bow string 16 rather than pushing against the nock 24 impacts the nock 24 in a slapping motion causing tremendous forces to be imparted to the nock 24 which can cause nock failure and even dry fire.

Figure 3:
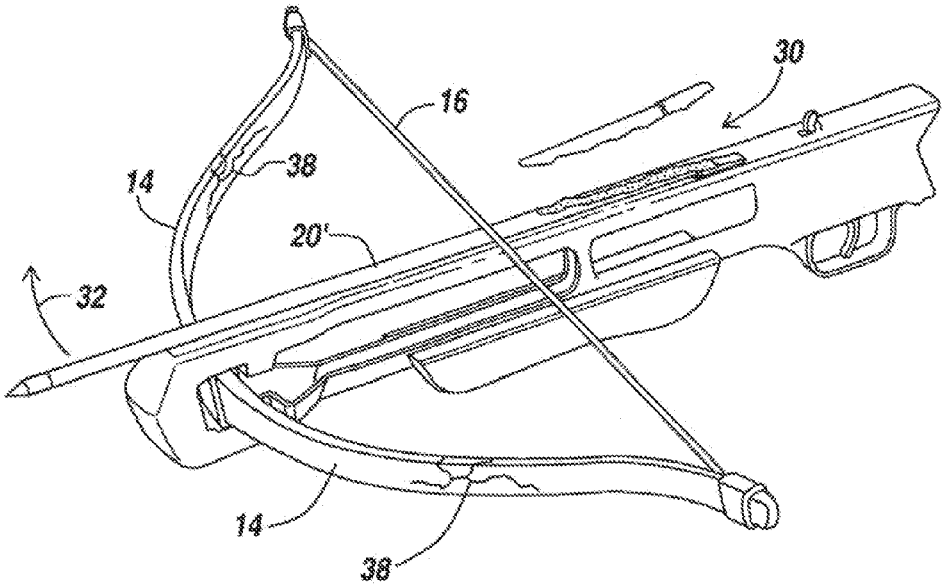
FIG. 3 is a diagrammatic illustration of a dry fire situation in which the unloaded bow string moves in a forward direction, causing the arms of the crossbow to snap or otherwise be damaged.

Referring to FIG. 3, the dry fire situation is indicated in which a fractured nock 30 no longer provides a load on bow string 16 such that arms 14 of the crossbow may fracture as illustrated at 38, again resulting in projectiles 20' directed back at the hunter or archer or to individuals who may be in the immediate vicinity of the hunter.

Figure 4:
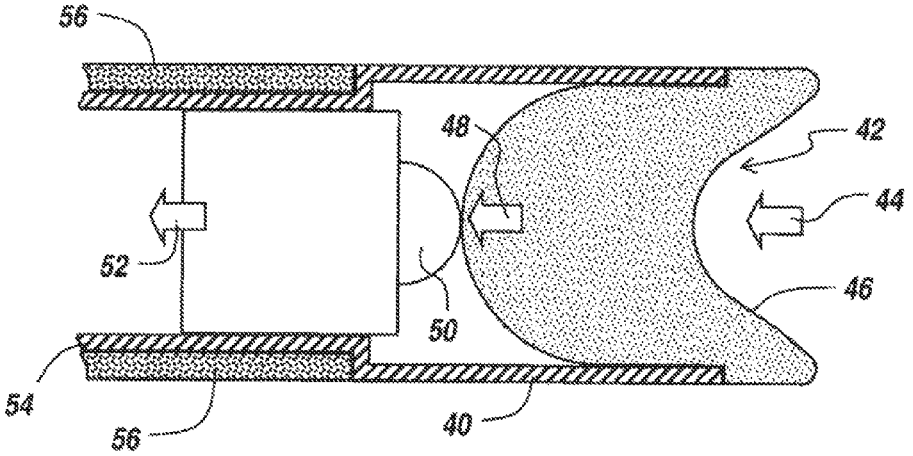
FIG. 4 is a diagrammatic illustration of the TPU shock absorber insert into a metal support structure which shows the motion of the TPU insert forward against an illumination source connected to a battery within the bolt or arrow shaft to activate the illumination source for providing an illuminated nock while at the same time absorbing the high loads due to bow string slap during crossbow operation.

Referring now to FIG. 4, in one embodiment a cylindrical nock support structure 40 is utilized to house a shock absorbing insert 42. Shock absorbing insert 42 in one embodiment is an injected moldable urethane in the form of a thermopolymer urethane or a thermoplastic urethane. Upon slap of the bow string a force 44 is imparted to the distal end 46 of the insert 42 which causes the insert 42 to slightly deform as well as move as illustrated by arrow 48 in the direction of a light assembly 50 causing the light assembly 50 to move in the direction of arrow 52 for activating a switch utilized to power the light assembly 50.

It has been found that injection molded TPU is not permanently deformable but rather has a memory such that after impact of the bow string it moves back to its original position, in one embodiment having actuated an internally carried light source. Further it is noted that support structure 40 which in one case is metal and preferably aluminum is inserted into a channel 54 in the distal end of a bolt here shown at 56 such that a unitary structure is provided with the metal support structure 40 being inserted into channel 54 and extending aft to receive the injection molded TPU shock absorbing insert 42.

Figure 5:
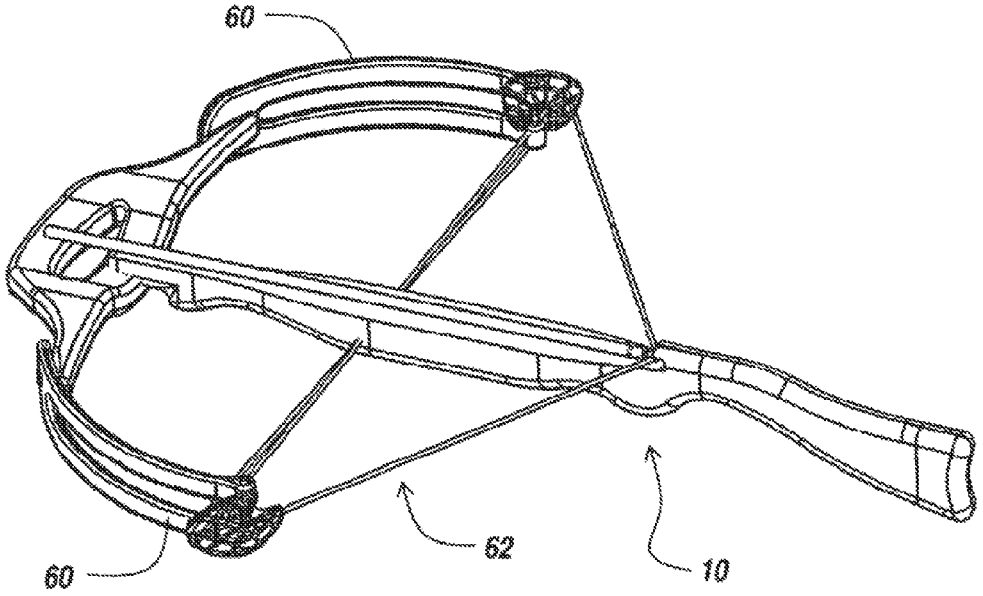
FIG. 5 is a diagrammatic illustration of a typical compound crossbow arrangement showing the mechanical advantage cams.

Typically a crossbow 10 shown in FIG. 5 incorporates the mechanical advantage of a compound bow structure 60 to deliver a stress in the nock from the impact in excess of 7000 psi to the distal end of the bolt. This compound bow bowstring structure is generally indicated at 62 and is not described further other than to say that the amount of energy deliverable by the bow string 62 of such an assembly 60 is more than that necessary to fracture the traditional nock at the end of a bolt.

Figure 6:
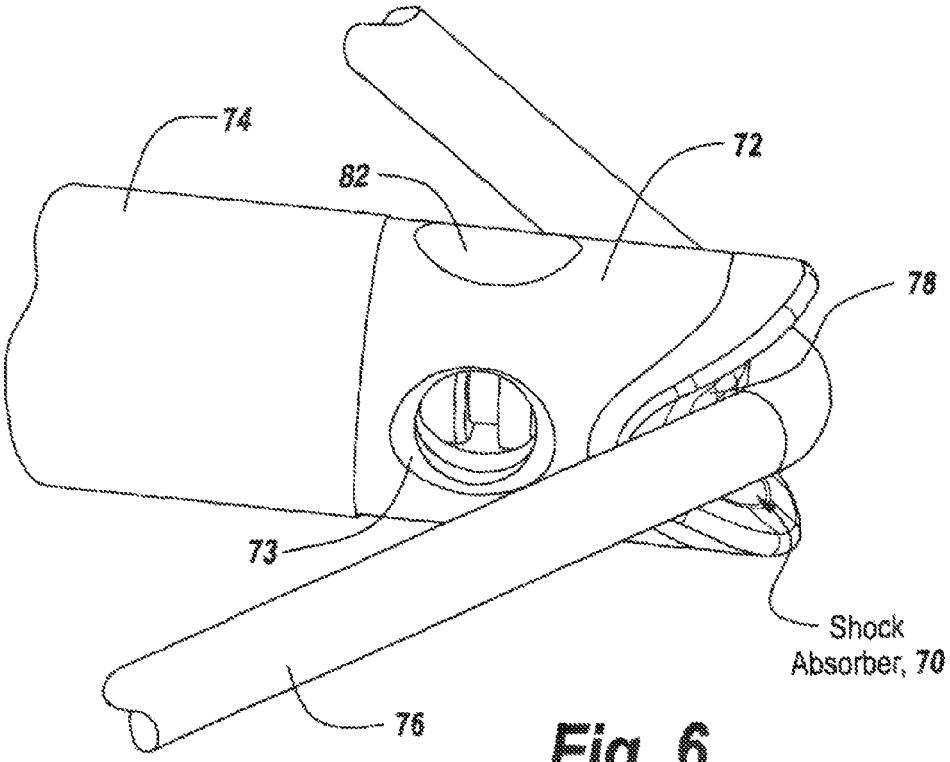
FIG. 6 is a diagrammatic illustration of one embodiment of the subject shock absorber which is impacted by the bow string, with the shock absorber shown as an insert to a metal retaining cylinder at the distal end of a crossbow bolt.

Referring now to FIG. 6, what is shown is a shock absorber 70 inserted into a cylindrical metal support structure 72 which is in turn inserted into a channel 74 in the bolt, with the bow string 76 adapted to contact an internal bow string receiving structure 78 to propel the bolt as a projectile in a forward direction when the bow string 76 is released.

Figure 7:
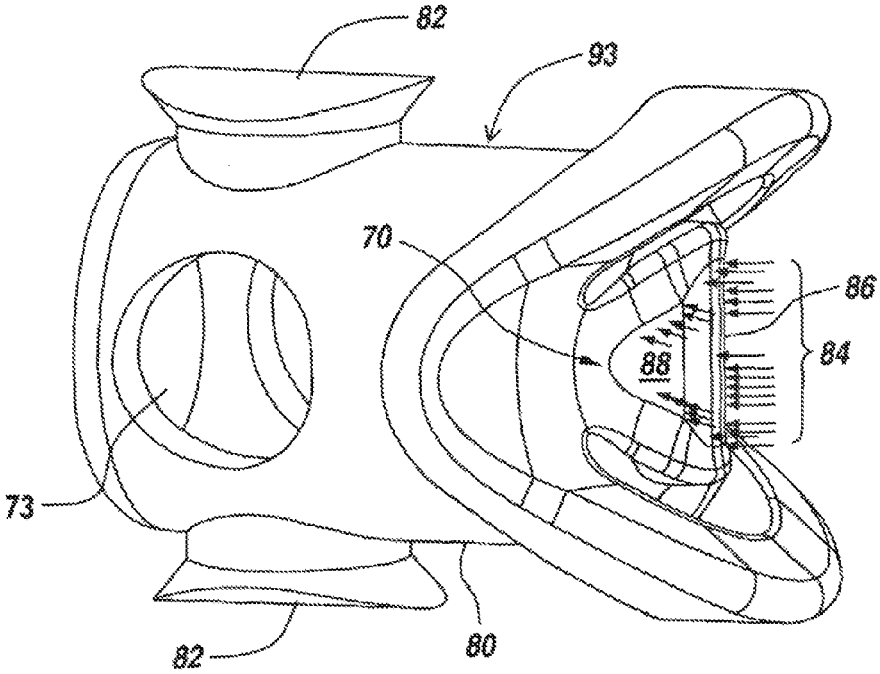
FIG. 7 is a diagrammatic illustration of the force imparted to the TPU insert of the nock in FIG. 6 illustrating the force concentration against the distal end of the insert followed by a focusing of the force to the center of the insert.

As illustrated in FIG. 7, the injection molded portion 70 is shown having a cylindrical forward structure 80 which has projections 82 utilized to join this insert 70 to the metalized support structure 72 of FIG. 6 by insertion into orifices 73 in the support structure 72.

As illustrated, the force imparted by the slap of the bow string is illustrated at 84 in terms of the arrows which impact first a transverse rib 86 which forms part of the shock absorber insert 70, with the force then tending towards the center of the insert 70 as illustrated by arrows 88.

Figure 8:
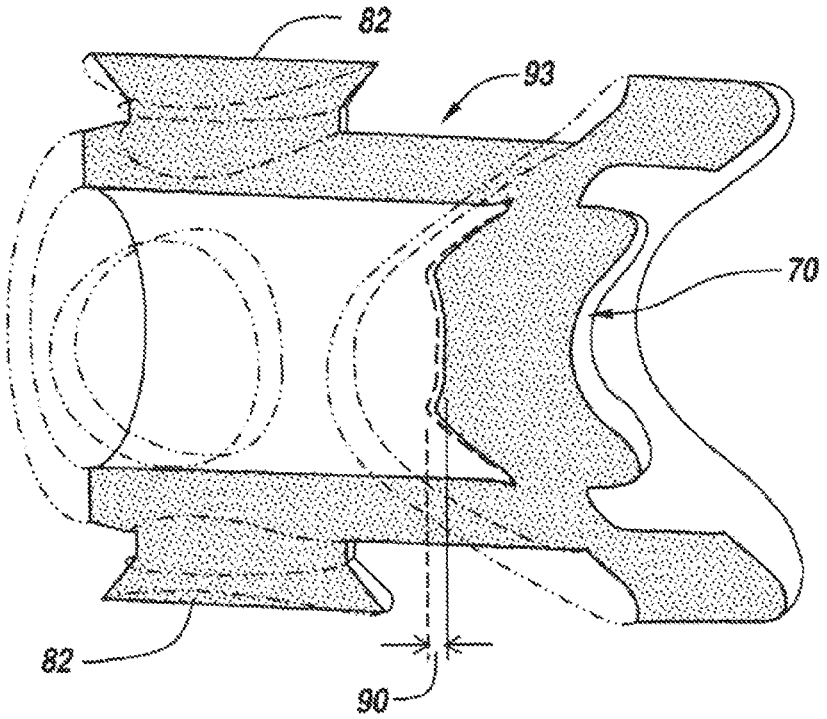
FIG. 8 is a diagrammatic illustration of the insert of FIG. 7 showing the movement of the proximal end of the insert so as to activate an internal lighting structure.
Figure 9:
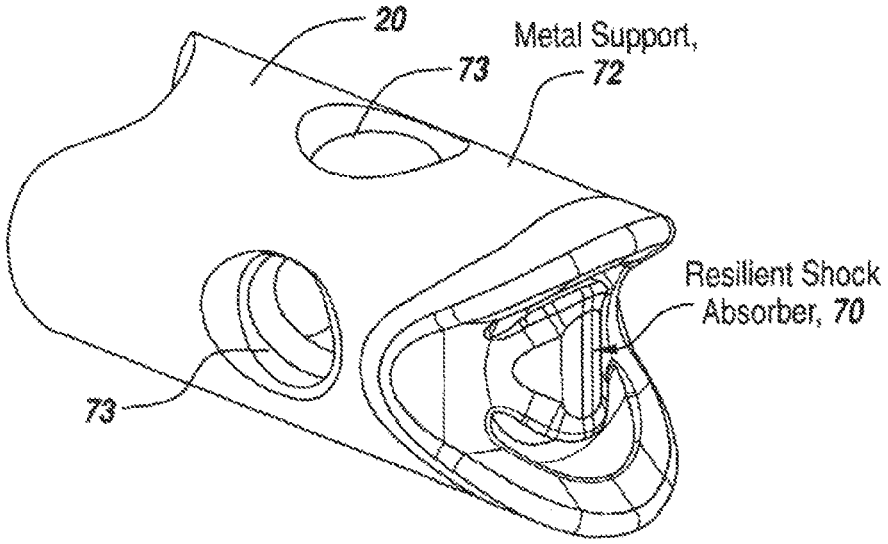
FIG. 9 is a detailed diagrammatic illustration of the resilient shock absorber insert into a metal reinforcing structure showing the resilient shock absorber at the distal end of the nock.

Referring to FIG. 8, the interior of the insert moves as illustrated by double ended arrow 90 to act as a shock absorber as well as in one embodiment to activate an internally carried nock light assembly. In FIG. 9 it can be seen that insert 70 is housed within metal support 72 such that it is able to move within this housing to provide the shock absorbing characteristics due to a flexible narrowed portion 75. Thus the shock absorbing insert 70 is surrounded by a metal support structure 72 to increase the structural rigidity and strength of the crossbow bolt nock.

Figure 10:
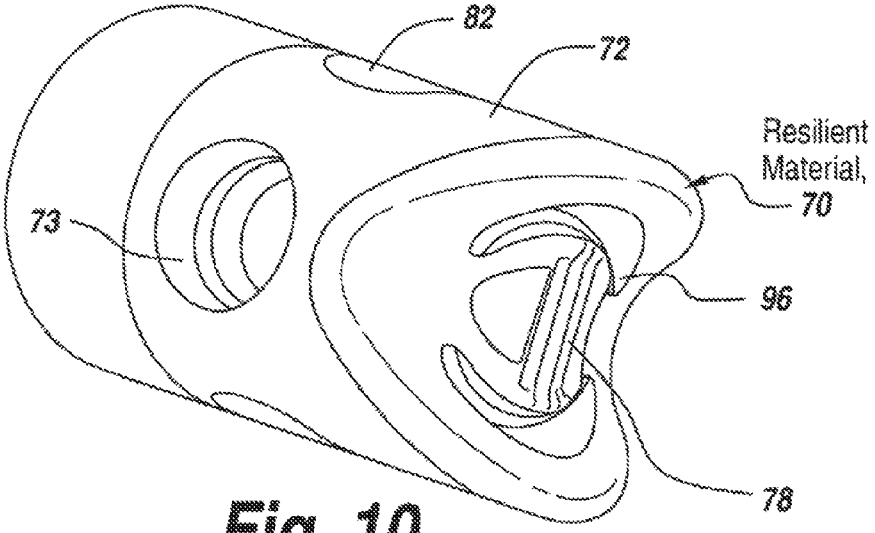
FIG. 10 is a diagrammatic illustration of one embodiment of the resilient shock absorber illustrating a bow string notch and a central protruding rib adapted to be contacted by the crossbow bow string.

Referring to FIG. 9, a more detailed view of the insert and nock structure is shown in which shock absorber 70 is shown carried by a metal support 72 which is inserted into a channel in bolt 20, whereas in FIG. 10 the resilient shock absorber 70 is shown having an overall nock structure shown by notch 96 which has internal to the notch a transverse rib 78 adapted to be struck by the bow string.

Figure 11:
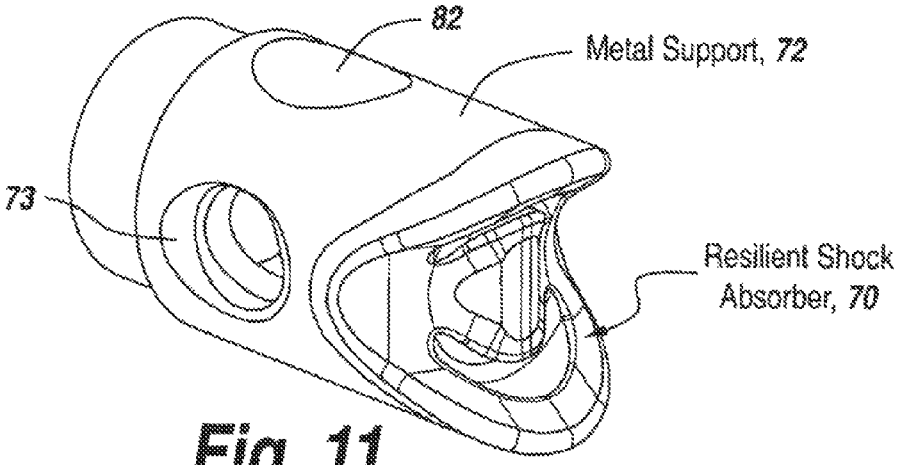
FIG. 11 is a further detailed diagrammatic illustration of the TPU resilient material insert surrounded by a metal reinforcing structure.
Figure 12:
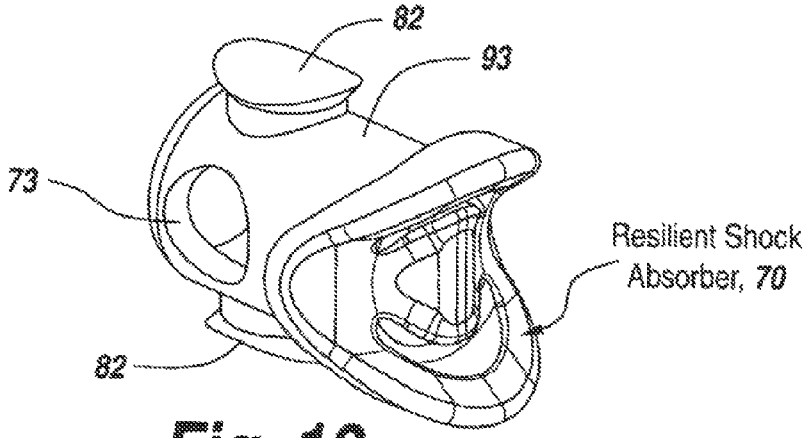
FIG. 12 is a diagrammatic illustration of the resilient injection molded insert to be inserted into the metal support structure of FIG. 11.

Referring to FIG. 11, the assembled structure with the resilient shock absorber insert and the metal support 72 is illustrated in which, as illustrated in FIG. 12, the resilient shock absorber insert 70 to be placed into a metal structure 72 has the aforementioned projections 82, which are adapted to lock into metal support 72.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A nock comprising:

a cylindrical support structure; and a shock absorbing insert, wherein the shock absorbing insert is at least partially inserted into the cylindrical support structure, wherein the nock comprises a lighting assembly housed within the cylindrical support structure, and wherein the shock absorbing insert is translucent.

2. The nock of claim 1, wherein the shock absorbing insert comprises an injection molded material.

3. The nock of claim 2, wherein the injection molded material comprises thermopolymer urethane or thermoplastic urethane.

4. The nock of claim 1, wherein the cylindrical support structure comprises aluminum.

5. The nock of claim 1, wherein the nock comprises a switch configured to activate the lighting assembly, and the shock absorbing insert is configured to move and close the switch upon an impact of a bowstring against the shock absorbing insert.

6. The nock of claim 1, wherein the shock absorbing insert comprises a notch configured to receive a bowstring.

7. The nock of claim 1, wherein the shock absorbing insert comprises a deformable material.

8. The nock of claim 7, wherein the deformable material is a resilient material configured to return to its original shape following deformation.

9. The nock of claim 1, wherein the shock absorbing insert comprises rubber.

10. The nock of claim 1, wherein the lighting assembly comprises a LED.

11. The nock of claim 10, wherein the shock absorbing insert is configured to move within the cylindrical support structure and contact the LED upon impact of a bowstring against the shock absorbing insert.

12. A nock comprising:

a cylindrical support structure; and a shock absorbing insert, wherein the shock absorbing insert is at least partially inserted into the cylindrical support structure, and wherein the shock absorbing insert comprises a rib configured to be struck by a bowstring.

13. A nock comprising:

a cylindrical support structure; and a shock absorbing insert, wherein the shock absorbing insert is at least partially inserted into the cylindrical support structure, and wherein the cylindrical support structure comprises orifices, and the shock absorbing insert comprises projections, wherein each projection is configured to be inserted into an orifice.

14. A nock comprising:

a cylindrical support structure; and a shock absorbing insert, wherein the shock absorbing insert is at least partially inserted into the cylindrical support structure, wherein the nock comprises a lighting assembly housed within the cylindrical support structure, wherein the lighting assembly comprises a LED, wherein the shock absorbing insert is configured to move within the cylindrical support structure and contact the LED upon impact of a bowstring against the shock absorbing insert, and wherein the LED is configured to move within the nock upon contact with the shock absorbing insert.

15. A nock comprising:

a cylindrical support structure; and a shock absorbing insert, wherein the shock absorbing insert is at least partially inserted into the cylindrical support structure, wherein the shock absorbing insert comprises a flexible narrowed portion.

16. The nock of claim 15, wherein the shock absorbing comprises a thermopolymer urethane.

17. The nock of claim 15, wherein the nock comprises a lighting assembly housed within the cylindrical support structure.

18. The nock of claim 17, wherein the lighting assembly comprises a LED.

* * * * *